United States Patent [19]

Monica

[11] Patent Number: 4,566,688

[45] Date of Patent: Jan. 28, 1986

[54] ACTUATION FOR SPRING MOUNTED HOBBY HORSE

[76] Inventor: Thomas A. Monica, Rte. 1, Cartersville, Ga. 30120

[21] Appl. No.: 591,955

[22] Filed: Mar. 21, 1984

[51] Int. Cl.[4] ..... A63G 13/08

[52] U.S. Cl. ..... 272/53.1

[58] Field of Search ..... 272/52, 52.5, 53.1, 272/53.2, 86; 5/109, 104, 108; 297/260, 181; 128/33; 446/280, 283, 285

[56] References Cited

U.S. PATENT DOCUMENTS

| | | | |
|---|---|---|---|
| 274,454 | 3/1883 | Barker | 5/109 |
| 1,791,777 | 2/1931 | Webb | 128/33 |
| 2,622,878 | 12/1952 | Mooney | 5/104 X |
| 2,884,651 | 5/1959 | Garey | 5/109 |
| 3,040,342 | 6/1962 | Broers | 5/109 |
| 3,371,358 | 3/1968 | Shackel | 5/109 X |
| 3,564,626 | 2/1971 | Nelson | 5/109 |
| 4,198,045 | 4/1980 | Miller | 128/33 X |
| 4,231,126 | 11/1980 | Hurkett | 5/108 X |
| 4,329,809 | 5/1982 | Reece | 272/53.1 X |

FOREIGN PATENT DOCUMENTS

| | | | |
|---|---|---|---|
| 2405674 | 6/1979 | France | 5/108 |
| 742697 | 12/1955 | United Kingdom | 272/53.1 |

*Primary Examiner*—Robert A. Hafer
*Assistant Examiner*—Arnold W. Kramer
*Attorney, Agent, or Firm*—Terrence (Terry) Martin

[57] ABSTRACT

In a hobby horse of the type where the body thereof is supported from four upright posts by retractile suspension springs, the present invention incorporates a drive apparatus for imparting a rocking motion to the hobby horse. The invention achieves differing oscillatory rates of horse movement according to the size and weight of the child. Timer and speed controls may be provided.

18 Claims, 7 Drawing Figures

FIG. 4
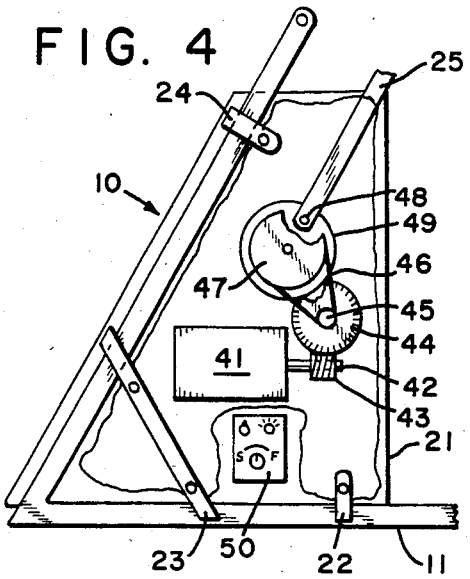
FIG. 4A
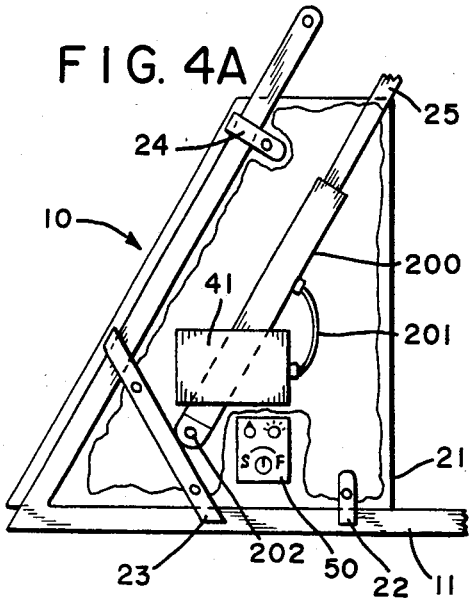
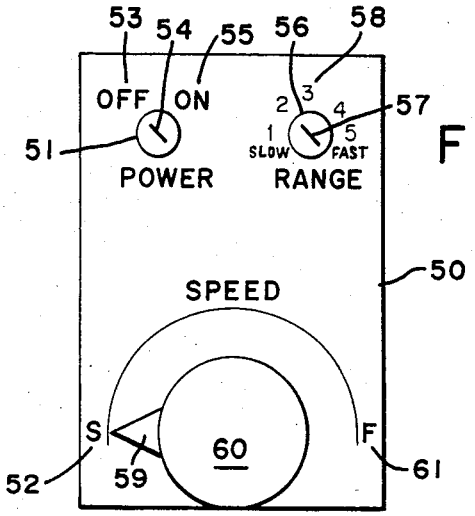
FIG. 5
FIG. 6
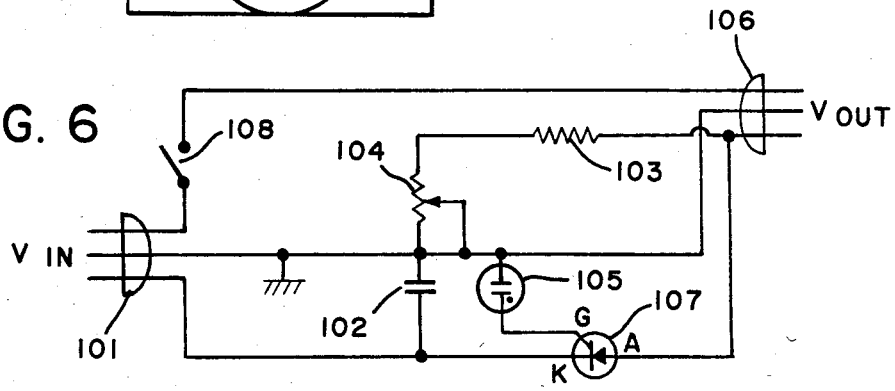

ACTUATION FOR SPRING MOUNTED HOBBY HORSE

TECHNICAL FIELD

This invention relates to children's toys, and more particularly, to hobby horses, rocking horses, and children's bucking bronco riding toys. Specifically, the present invention relates to means to rock, buck, or shake a hobby horse suspended from a frame means by a plurality of springs.

BACKGROUND ART

Children's hobby horses have been made and used by parents to entertain children for centuries. As early as 1927, U.S. Pat. No. 1,647,507 was issued to Cross for a mechanically operated toy, utilizing an extremely complex drive mechanism, operated by motion along a continuous track, to cause the mechanical "horse" to simulate the action of a race horse.

In 1960, U.S. Pat. No. 2,937,022 issued to Koller et al for a hobby horse frame, in which a light-weight, plastic-bodied model horse is reinforced by supports, crossrods or dowels and suspended from a frame means by four sturdy retractile springs. Movement is imparted by rocking action of the child against the springs. Continuous action by the child is required for a longer duration ride, and children often tire of the ride after short periods. Smaller children must necessarily "learn" how to ride the toy, and children of any size suffering from mental impairment may not derive full enjoyment for many reasons, including imperfect coordination.

U.S. Pat. No. 2,988,847 to Smith (1961) discloses a bucking and galloping "broncho", in which each of the animal's four legs is mounted on a wheel, at least some of which wheels include eccentricities to impart motion to the bottom of the toy animal's legs. A centrally located transverse pivot secured to side frames by a pair of parallel uprights enables a back and forth, bucking ride for the toy rider, which is permitted to bounce up and down on a fixed vertical shaft, imparting animation to the entire toy. It is not suitable for children to ride or sit upon.

More recently, U.S. Pat. No. 4,329,809 issued to Reece in 1982. The Reece apparatus clearly envisions a much more violent rocking action than any of the foregoing or of the invention, as it discloses a rather large, horned Brahma bull animal caricature mounted in the back of an ordinary pick up truck, to one or more of the rear axles on which is mounted an eccentric wheel. The bull is mounted upon a strong or stout helical spring attached to the axle housing to enhance the bucking bull action.

Also known for many years are the small models of conventional circus merry-go-rounds found in many commerical areas which are frequented by children accompanied by parents likely to have a few spare coins. These smaller merry-go-rounds may have as many as three small horses adapted for small children to sit upon, and they traverse a circular path about the hub to the accompaniment of carnival music. The "horses" are axially displaced from the hub pole, secured to radial elements extending from the hub pole. Additionally, a larger, one person toy horse is sometimes encountered supported from oscillating rods attached to its underbelly, imparting a back-and-forth simulated bronco action. In both of the foregoing apparatus, operation is secured by payment of coins to a mechanical coin box, usually at the insistence of the child. Additional coins may be required to continue the ride for a disappointed child. These machines are too costly for the ordinary family to purchase and maintain.

Of the foregoing, the present invention is most nearly suited for adaption to and improvement of the Koller patent. Examples of same are to be found in children's stores today in the moderately higher-priced toy range. Many thousands of these exist, and being sturdy, usually long outlast two or three children in a family. Many thousands more are manufactured each year, in several sizes. A large market therefore exists for a moderately priced means to impart mechanical rocking motion to such a hobby horse, and which can easily and economically be retrofit to used hobby horses or supplied as a component part of or supplement to new hobby horses. Although primarily directed to home use, such apparatus are certainly economical and practical enough for use in physician's offices and other waiting areas where bored children can be advantageously entertained at very low cost.

Accordingly, there has arisen a need for an inexpensive, safe, easily retrofit apparatus to impart a "bucking bronco" action to spring mounted hobby horses.

DISCLOSURE OF INVENTION

The present invention achieves "bucking" action in spring mounted hobby horses by imparting oscillatory action to a point along the length of at least one of the suspension mounting springs. With the apparatus of the present invention, the point of attachment along the length of the suspension spring can be selected to provide a range of rocking action safely suitable to the size and ability of the child rocker, and the use of a variable speed motor is contemplated so as to provide variation within the range selected. It should be noted that by imparting rocking action to the spring at a point along the length thereof, differing oscillatory rates of horse movement will be in part dependent on the size and weight of the child. That is, large children rock harder, due to the spring action, than do smaller children. The oscillatory action is imparted to the spring by means of a reciprocating lever driven by an eccentric cam on a gearbox. Hydraulic or pneumatic means may also be used to bounce the spring at the desired rate and travel. Motor speed controls of the silicon-controlled rectifier type may be used to control the speed of the drive motor. "Deadman" type safety switches may be included on the handle or in the seat for added safety. It is therefore an advantage of this invention to provide economical means to impart rocking or bucking bronco action to a children's toy.

Another advantage of this invention is that the mechanism to impart rocking or bucking action to a spring mounted children's hobby horse may be easily and conveniently installed.

Yet another advantage of the present invention is that a range of bucking or rocking action can be selected by attachment of the movement imparting means to selected points along the length of the retractile suspension mounting springs.

And still another advantage of the present invention is that a range of bucking or rocking speeds can be selected by varying the operating speed of the drive apparatus within predetermined ranges corresponding to bucking speeds.

Another advantage of the invention disclosed is that within the range of bucking action selected, shorter and lighter riders receive milder rides and taller, heavier riders receive more vigorous rides.

And another advantage of the invention disclosed is that of safety, as the vigorousness of the ride is in part dependent on the child's size, within selectable gradations.

These and other advantages will become apparent upon a review of the drawings, the description of the preferred embodiment, and the appended claims which follow.

BRIEF DESCRIPTION OF THE DRAWINGS

Numerous features of the invention disclosed herein will become apparent upon examination of the several drawing figures forming a part hereof, and in which like reference characters indicate corresponding parts in all views:

FIG. 4 illustrates in simplified form an exemplary drive mechanism with which the reciprocating arm can be oscillated according to a preferred embodiment of the invention;

FIG. 4A illustrates another configuration of drive mechanism;

FIG. 5 shows the operating controls for the invention according to an embodiment of the invention; and FIG. 6 shows a conventional silicon-controlled rectifier speed control of known type.

DETAILED DESCRIPTION OF THE PREFERRED EMBODIMENT

Turning now to a detailed description of the elements of the invention in a practical, working embodiment, the interrelationship of the parts and their operation are now to be described.

Figure 1:
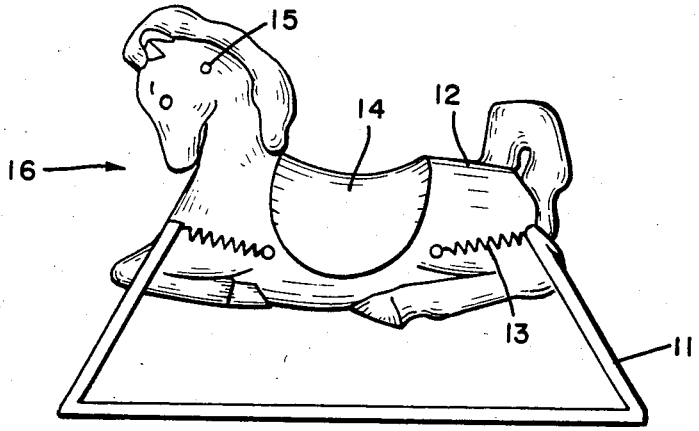
FIG. 1 illustrates a hobby horse of the type with which the invention may be readily practiced.

In FIG. 1 is shown generally a hobby horse apparatus 16 to which the present invention 10 may be attached and/or retrofit and operated, including a frame means 11, hobby horse body 12, suspension mounting spring(s) 13, saddle 14, hand hold 15, and the hobby horse body per se 12. The hand hold 15 is a rod, dowel, or the equivalent passed transversely through the horse's head and secured at a convenient place for children to grasp with their hands when seated in the saddle 14, formed integrally with the horse body 12. A "deadman" type electrical safety switch may be incorporated with the handgrip to complete connection of electrical power to the motor drive means, as will be described in greater detail hereinafter. The horse is suspended by a plurality of retractile springs 13 from frame means 11. In use, a rider sits atop horse 12 seated in saddle 14, holding handle 15, and rocking the horse 12 back And forth against the springs 13, which thereafter rebound the horse and rider.

Figure 2:
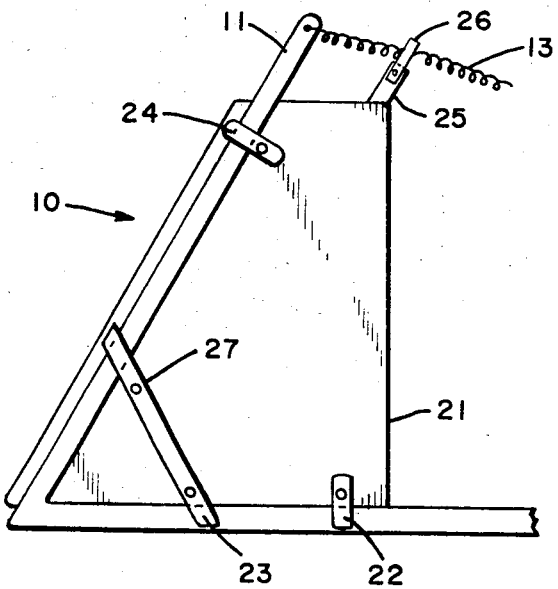
FIG. 2 illustrates the addition of the present invention to the hobby horse of FIG. 1, including attachment of the invention and the reciprocating arm thereof to a suspension mounting supporting spring of the hobby horse.

In FIG. 2 there is shown the hobby horse improvment 10 of the present invention, frame means 11, suspension mounting spring 13, drive mechanism package 21, drive mechanism mounting braces or brackets 22, 23, 24, reciprocating arm 25, arm/spring clamp 26, and a plurality of fasteners, as represented by fastener 27. The drive mechanism package 21 is securely fastened to the frame 11 with a plurality of braces 22, 23, 24 and fasteners such as 27. One or more longer brace elements such as 23 may be used to reinforce the drive mechanism package 21 outer covering in case it is desired to make same from plastic, fiberglass or other lightweight materials. The eccentric arm 25 extends from and beyond the drive mechanism package 21 to be securely attached to spring 13 along its length at the mid portion thereof by clamp means 26, shown more clearly in the succeeding figure. Clamp 26 is shown secured with a single fastener in FIG. 2, and is to be fastened with an appropriate number and kind of fasteners as may be determined by a skilled artisan.

Figure 3:
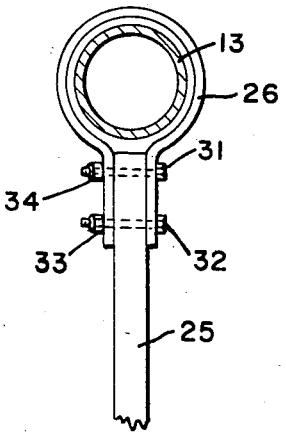
FIG. 3 shows details of the clamp arm arrangement for securing the reciprocating arm of the invention to the hobby horse suspension spring.

Turning now to FIG. 3, there is shown a section view of the spring 13, reciprocating arm 25, clamp 26, and fasteners 31, 32 with associated nuts 33, 34. For the purposes of illustration, spring 13 is shown slightly smaller than clamp 26, and two clamp screws 31, 32 are shown in this figure. In actual practice, the clamp 26 securely grasps spring 13. The nuts 33, 34 should be of the self-locking kind and of the highest security type available to ensure the clamp will not loosen unintentionally.

FIG. 4 illustrates one of any number of different configurations of drive mechanism suitable for rocking the hobby horse body. Included are the drive mechanism package 21 with portions of its cover shown removed to enable viewing the inner workings of the drive. In this example, but not for limitation, a double reduction drive system is shown. The hobby horse improvement 10 in this example includes frame 11, drive mechanism package 21, drive mechanism mount braces 22, 23, 24, reciprocating arm 25, and a plurality of fasteners represented by fastener 27. Also included are drive motor 41, drive shaft 42, worm-drive screw 43, worm-driven gear 44, timing belt drive sprocket 45, drive belt 46, driven sprocket 47, pintle 48, rotating eccentric wheel 49, and operating control package 50. The drive motor is attached to one wall of the drive mechanism package 21. Worm-drive gear 43 is attached to rotating motor drive shaft 42 and in turn engages worm-driven gear 44, which rotates on an axle or shaft. Secured to and rotating with driven worm-gear 44 is drive sprocket 45, connected by drive belt 46 to communicate motion to driven sprocket 47 via timing belt 46 or the equivalent. Driven sprocket 47 is separated from eccentric wheel 49 upon which is mounted a pintle 48. Reciprocating arm 25 has at its drive end an aperture adapted to encircle pintle 48, which aperture may include therein suitable low friction bearing means. Operating control package 50 is shown in this example as being mounted on a side wall of the drive mechanism package, as it would ordinarily be in home use. However, the control package 50 may easily be mounted remotely, as for example in a physician's office, where the control package 50 could be mounted on a receptionist's desk to avoid unauthorized use.

FIG. 4A illustrates another configuration of drive mechanism suitable for rocking the hobby horse body. Included are the drive mechanism package 21 with portions of its cover shown removed to enable viewing the inner workings of the drive. In this example, but not for limitation, a hydraulic drive system is shown. The hobby horse improvement 10 in this example includes frame 11, drive mechanism package 21, drive mechanism mounting braces 22, 23, 24, reciprocating arm 25, and a plurality of fasteners. Also included are fluid cylinder 200 (which may be either gas or liquid operated) from which extends reciprocating arm 25, and pulsating fluid pressure drive means 41. A suitable fastener 202 secures the fixed end of the fluid cylinder to the cover of the drive mechanism package 21. The fluid pressure drive means 41, which may for example receive its operating power electrically, provides a source of pulsating fluid pressure to fluid cylinder 200 via a suitable conduit 201 known to those of ordinary skill in the fluid pressure arts. Operating control package 50 is shown in this example as being mounted on a side wall of the drive mechanism package, as it would ordinarily be in home use. However, the control package 50 may be easily mounted remotely as with FIG. 4, as for example in a physician's office, where the control package 50 could be mounted on a receptionist's desk to avoid unauthorized use.

An exemplary operating control panel 50 is shown in FIG. 5, including thereon POWER switch 51, SLOW position 52, OFF position 53, key slot 54, ON position 55, RANGE switch 56, key slot 57, a plurality of range speed indicators such as "3" 58 in a range of from "1" "5", pointer 59 extending from control knob 60, and FAST position 61. The specific details of the operating control package 50 are not illustrated as such is deemed within the ordinary ability of the skilled electronics technician. By way of example, however, the SPEED and RANGE controls may be portions of an ordinary silicon-controlled rectifier motor control package. A single speed control SCR motor drive circuit is described hereinafter in a configuration suitable for certain alternating current electric motors. POWER and RANGE switches 51 and 56 are illustrated as key lock-switches of the type requiring a key to operate; this is suggested for safety. In operation, the key (not shown) is inserted in key slot 54 and rotated, actuating the main power switch to enable operation of the control package 50. Another key (also not shown) is inserted into key slot 57 and is used to select the speed RANGE from "1" (slowest range) to "5" (highest speed range) with switch 56. Rotation of the SPEED knob 60 initiates oscillation of the reciprocating arm by starting the drive mechanism. Motor 41 rotates shaft 42 and worm-drive screw 43, rotating worm-driven gear 44, which is connected to drive sprocket 45, and which transmits rotating power to driven sprocket 47 via timing drive belt 46. Rotation of the driven sprocket causes rotation of eccentric wheel 49 on which pintle 48 is mounted, and causes the reciprocating arm to agitate the spring 13 (not shown in this figure) and rock the hobby horse.

An operating test unit was constructed incorporating a variable-speed electric motor drive coupled to a gear reducer driving the reciprocating arm. The present invention, contemplates, however, that motive force for thrusting the spring may be derived from a pulsating fluid pressure source or the equivalent, driving a fluid cylinder shaft, as well as electric and more conventional motors. In such a fluid reciprocation version, the fluid pressure and the fluid cylinder could be either a liquid, a gas, or a vapor such as steam. It was experimentally determined in the test model that attaching the reciprocating arm at each of several points along the length of the suspension spring varied the ride response, and especially the spring response depending on the size of the child. It was also discovered that best operation was derived, in the particular circumstances of the experimental model, at a reciprocating arm thrust rate of from about 50 to about 200 thrusts per minute and a reciprocating arm travel of from about one-fourth to about three inches, and particularly about one and one-fourth inches at a rate of about 120 to about 130 thrusts per minute.

FIG. 6 shows a simple silicon-controlled rectifier based power supply useful with ac motors. An input connector 101 supplies ac power to a trigger circuit 102, 103, 104, and 105. When the voltage across 102 reaches the ignition voltage of neon lamp 105, the neon lamp fires and sends a pulse to the gate of the SCR. The setting of speed control 104 determines the charging rate of 102 and thus the conduction angle of the SCR. Decreasing 104 increases the speed of the motor connected at the output connector 106. Varying the resistance of 103 by keyswitching different resistances in substitution thereof may be used to vary the range of motor speeds. One or more "deadman" switches may be connected in series with power switch 106 to ensure the rider is mounted and holding on to the handle 15.

I claim:

1. Apparatus for rocking a children's riding toy suspended from a frame having a plurality of generally upright members by a plurality of retractile springs each of which is attached at one end to said toy and at the other end to a frame member; comprising:

(a) at least one reciprocating arm means for imparting rocking motion perpendicular to the longitudinal axis of at least one of the retractile springs, (b) clamp means for securing said reciprocating arm to at least one of the retractile springs along the longitudinal axis thereof, and (c) drive means for reciprocating said reciprocating arm, wherein the reciprocating arm travel is within a range of from one-fourth inch to about three inches.

2. Apparatus as in claim 1, further including control panel means for regulating the application of power to said drive means and key lock switch means for disabling said drive means.

3. Apparatus as in claim 2, further including speed regulating means for selectively adjusting the speed of said rocking motion.

4. Apparatus as in claim 2, further including means to limit the maximum and minimum speed of said rocking motion within at least one of a plurality of speed ranges.

5. Apparatus as in claim 1, wherein the reciprocating speed is within a range of 60 to 200 thrusts per minute.

6. Apparatus as claim 5, wherein the reciprocating speed is preferably within a range of from 120 to 130 thrusts per minute.

7. Apparatus as in claim 1, wherein the clamp means adjustably secures the reciprocating arm to the retractile spring at a selected one of a plurality of points along its length between one-fourth way from the toy to three-fourths way toward the frame upright member.

8. Apparatus as in claim 7, wherein the clamp means is secured to the retractile spring at a point along the length therof substantially half-way between the toy and the frame upright member.

9. Apparatus as in claim 1, wherein said drive means includes an electric gear reduction motor.

10. Apparatus as in claim 1, wherein said drive means comprises a pulsating fluid pressure and said reciprocating arm is a fluid cylinder shaft.

11. Apparatus as in claim 10, wherein said fluid is a gas.

12. Apparatus as in claim 10, wherein said fluid is a liquid.

13. Apparatus as in claim 1, wherein said reciprocating arm is substantially vertically disposed.

14. Apparatus as in claim 1, wherein said reciprocating arm is substantially horizontally disposed.

15. Apparatus as in claim 1, characterized in that smaller, shorter children receive a mild ride and larger, taller children receive a more vigorous ride for a given combination of reciprocating arm travel, reciprocating speed, spring size and rate, and reciprocating arm point of attachment along the length of the spring.

16. Apparatus as in claim 1, which incorporates at least one 'deadman switch' for safety.

17. Apparatus as in claim 1, wherein the reciprocating arm travel is about one and one-fourth inches.

18. Apparatus as in claim 1, wherein the reciprocating arm travel is about one and one-fourth inches and the reciprocating speed is within a range of from about 120 to about 130 thrusts per minute.

* * * * *